US008217365B2

(12) United States Patent
Chen et al.

(10) Patent No.: US 8,217,365 B2
(45) Date of Patent: Jul. 10, 2012

(54) DOUBLE-FACED ION SOURCE

(75) Inventors: Zhiqiang Chen, Beijing (CN); Yuanjing Li, Beijing (CN); Hua Peng, Beijing (CN); Qingjun Zhang, Beijing (CN); Jin Lin, Beijing (CN); Shaoji Mao, Beijing (CN); Zhude Dai, Beijing (CN); Shiping Cao, Beijing (CN); Zhongxia Zhang, Beijing (CN); Yangtian Zhang, Beijing (CN); Dexu Lin, Beijing (CN); Qinghua Wang, Beijing (CN); Shaofeng Wang, Beijing (CN); Hui Li, Beijing (CN)

(73) Assignee: Nuctech Company Limited, Beijing (CN)

( * ) Notice: Subject to any disclaimer, the term of this patent is extended or adjusted under 35 U.S.C. 154(b) by 123 days.

(21) Appl. No.: 12/437,044

(22) Filed: May 7, 2009

(65) Prior Publication Data

US 2009/0283694 A1 Nov. 19, 2009

(30) Foreign Application Priority Data

May 19, 2008 (CN) ..... 2008 1 0111942

(51) Int. Cl.
*H01J 27/20* (2006.01)
*H01J 49/14* (2006.01)

(52) U.S. Cl. ..... 250/423 R; 250/281; 250/287

(58) Field of Classification Search ..... None
See application file for complete search history.

(56) References Cited

U.S. PATENT DOCUMENTS

| | | | | |
|---|---|---|---|---|
| 3,589,374 | A * | 6/1971 | Aoki et al. | 131/299 |
| 4,445,038 | A * | 4/1984 | Spangler et al. | 250/382 |
| 4,950,893 | A * | 8/1990 | Reategui et al. | 250/282 |
| 5,856,784 | A * | 1/1999 | Wiemeyer | 340/629 |
| 6,064,070 | A * | 5/2000 | Schnurpfeil et al. | 250/423 R |
| 6,145,391 | A | 11/2000 | Pui et al. | 73/865.5 |
| 6,589,502 | B1 * | 7/2003 | Coniglione et al. | 424/1.25 |
| 6,749,553 | B2 * | 6/2004 | Brauckman et al. | 600/3 |
| 6,787,763 | B2 * | 9/2004 | De La Mora et al. | 250/287 |
| 7,259,369 | B2 | 8/2007 | Scott et al. | 250/287 |
| 2009/0127449 | A1 * | 5/2009 | Iwatschenko-Borho | 250/252.1 |

OTHER PUBLICATIONS

Ring. (Mar. 21, 2005). Retrieved Aug. 3, 2011, from Wayback Machine Web Site: http://answers.com/topic/ring.*

Chinese Office Action from corresponding Application No. CN 200810111942.1, dated May 18, 2010.

(Continued)

*Primary Examiner* — Jack Berman
*Assistant Examiner* — Eliza Osenbaugh-Stewart
(74) *Attorney, Agent, or Firm* — Westman, Champlin & Kelly, P.A.

(57) ABSTRACT

Disclosed is an ion source comprising a plate-shaped source body which has radioactivity on its both sides and allows positive and negative ions to penetrate through the source body. The present invention gives beneficial effects. First, the ion source structure can improve the ionization efficiency of sample molecules, and the generated sample ions have a centralized distribution within a flat space on both sides of the source body. Such distribution of ion cloud facilitates to improve the IMS sensitivity. Meanwhile, the source body of the present invention has a transmittance in itself. Thus, positive and negative ions generated on both sides of the source body can penetrate through the source body and be separated to the both sides of the source body. In this way, it is possible to improve the utilization efficiency of ions.

4 Claims, 2 Drawing Sheets

OTHER PUBLICATIONS

Chinese Office Action from corresponding Application No. CN 200810111942.1, dated Apr. 25, 2011.

German Office Action from corresponding Application No. DE 102009019671.9-54, dated Mar. 15, 2011.

German Office Action (with English translation) from corresponding German Application No. 10 2009 019 691.9, dated Mar. 26, 2012, 6 pages.

* cited by examiner

DOUBLE-FACED ION SOURCE

The present application claims priority of Chinese patent application Serial No. 200810111942.1, filed May 19, 2008, the content of which is hereby incorporated by reference in its entirety.

BACKGROUND OF THE INVENTION

1. Field of Invention

The present invention relates to an ion source for use with analysis and discrimination of substance with dual ion mobility technology, which belongs to a technical field of safety inspection.

2. Description of Prior Art

The dual ion mobility spectrometer (dual IMS) can simultaneously detect molecules having positive and negative ion affinity, and thus can conduct detection of various types of substances, such as drugs and explosives. This characteristic enables a wide application of the dual IMS.

The conventional ion sources, however, are designed primarily for single IMS. Such ion sources, when applied to the dual IMS, will have noticeable shortcomings, such as a low ionization efficiency of sample molecules, a low effective utilization of ions, and unreasonable ion source structure.

Currently, some ion sources dedicated to the dual IMS have disadvantages, too. In U.S. Pat. No. 7,259,369B2, for example, sample molecules after ionization in an ionization chamber external to the system are carried by carrier gas into a quad-polar ion trap at the center of the dual IMS. Then, ions stored in the ion trap enter positive and negative ion drift tubes at both ends of the dual IMS, respectively, for further measurement.

The ion source in the above patent has the advantage of being not limited by ionization approach and source body shape, and can be any one of the existing ion sources, such as radioactive isotope, corona or laser. On the other hand, the ion source has disadvantage of a significant reduction of effective utilization of ion, since a larger number of ions are lost in the course of sample ions migrating from the ion source to the ion trap. Further, the separate ionization chamber adds to the volume and production cost of the IMS.

In addition, to improve ionization efficiency, ion cloud generated by a general radioactive source for IMS has a broad distribution range. As shown in FIG. 1, the ion cloud 12 generated by the tube-shaped Ni63 source 11 is distributed in a broad space along the direction of tube axis, and such distribution leads to a bad resolution for the IMS.

SUMMARY OF THE INVENTION

In view of the above, the present invention provides an ion source structure used in dual IMS, this structure can fundamentally increase the ionization efficiency and IMS's sensitivity. This invention allow a reduction in the ion source's radioactivity strength, and increase the effective utilization of ions by allowing positive and negative ions to penetrate through the ion source.

In an aspect of the present invention, it provides an ion source comprising a plate-shaped source body which has radioactivity on its both sides, and allows positive and negative ions to penetrate through the source body.

Preferably, the source body is formed of radioactive isotope material.

Preferably, the source body has a thickness between 0.01 mm and 1 mm.

Preferably, the radioactivity strength of the source body is in the range of 0.5-10 mCi.

Preferably, the transmittance of the ion source is 25%-95%.

The present invention gives beneficial effects. First, the ion source structure can improve the ionization efficiency of sample molecules, and the generated sample ions have a centralized distribution within a flat space on both sides of the source body. Such distribution of ion cloud facilitates to improve the IMS sensitivity. Meanwhile, the source body of the present invention has a transmittance in itself. Thus, positive and negative ions generated on both sides of the source body can penetrate through the source body and be separated to the both sides of the source body. In this way, it is possible to improve the utilization efficiency of ions.

BRIEF DESCRIPTION OF THE DRAWINGS

The above advantages and features of the present invention will be apparent from the following detailed description on the preferred embodiments taken conjunction with the drawings in which.

DETAILED DESCRIPTION OF THE PREFERRED EMBODIMENTS

Now, preferred embodiments of the present invention will be described with reference to the figures, in which the same reference symbol, though shown in different figures, denotes the same or like component. For the purpose of clarity and simplicity, detailed description of known functions and structures incorporated here will be omitted, otherwise it may obscure the subject matter of the present invention.

Figure 1:
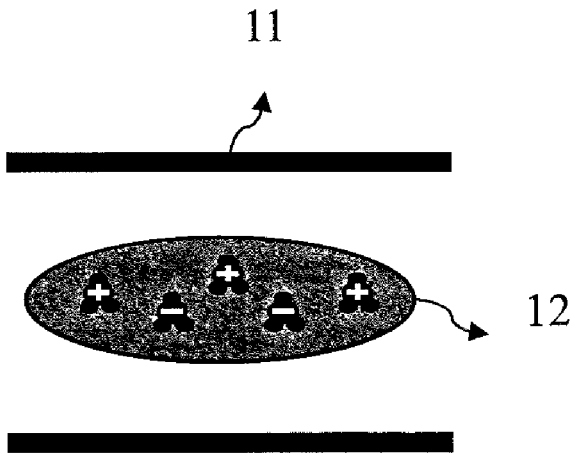
Fig. 1 Prior Art
FIG. 1 is a schematic diagram of ion cloud generated by a conventional tube-shaped ion source.
Figure 2:
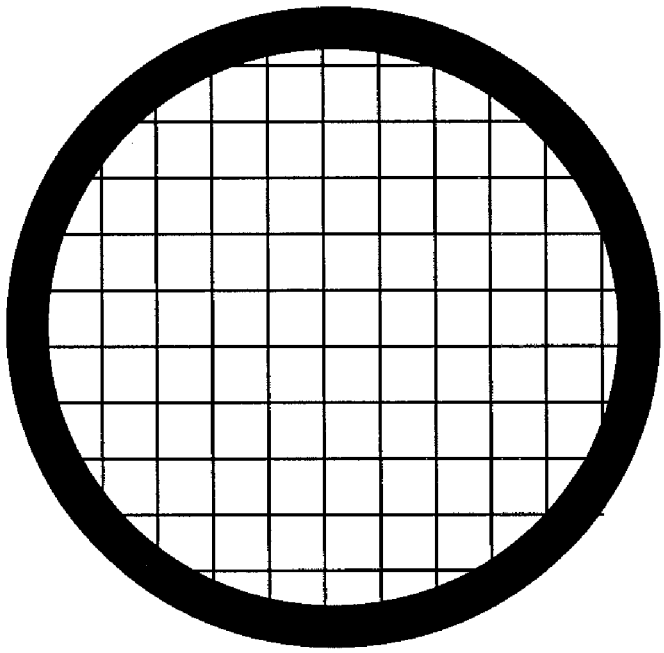
FIG. 2 is a schematic diagram of the structure of the ion source according to an embodiment of the present invention.

FIG. 2 is a schematic diagram of the structure of the ion source according to an embodiment of the present invention. As shown in FIG. 2, the ion source of this embodiment is a meshy double-faced circular isotope ion source having radioactivity.

The ion source in FIG. 2 is formed of radioactive isotope material. It is a plane source of a thickness (0.01-1 mm), with the outline shape being a circular plate, rectangular panel, etc. Both sides of the source body are radioactive with total activity between 0.5 mCi and 10 mCi. The ion source has a transmittance from 25% to 95% and allows positive and negative ions to penetrate through the source body. So, the ion source can be a structure having penetrability, such as a meshy structure, a structure with a large hole or multiple small holes at the center, or a structure of hole covered by a mesh and the like.

Figure 3:
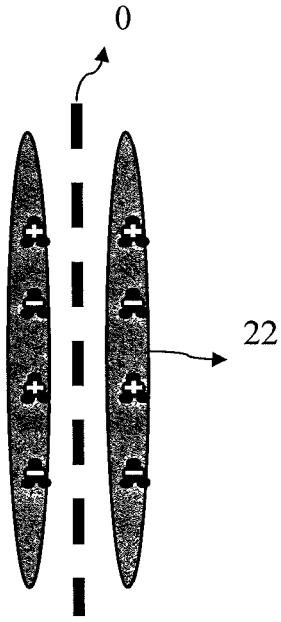
FIG. 3 is a schematic diagram of ion cloud generated by an ion source according to an embodiment of the present invention.

As shown in FIG. 3, the ion cloud 22 generated by the ion source 0 of the present embodiment is primarily centralized in a flat space on each side of the source body. Compared with a general radioactive isotope source for IMS, the ion source of the present invention can facilitate to increase IMS resolution and reduce radioactivity strength of the ion source.

Figure 4:
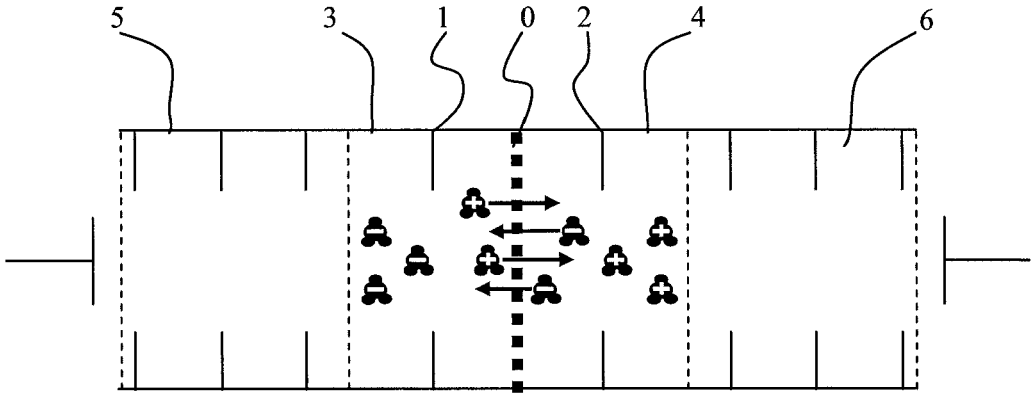
FIG. 4 is a schematic diagram of application of the ion source according to an embodiment of the present invention.

FIG. 4 is a schematic diagram of application of the ion source according to the embodiment of the present invention. Here, a dual IMS is formed of the ion source 0, a drift tube 6 for positive ion, a drift tube 5 for negative ion, a gate 4 for positive ion, a gate 3 for negative ion and the like. The ion source is arranged at the center of the dual IMS.

Among the electrodes on both sides of the ion source 0, the electrode 1 is provided with a potential higher than that of the ion source 0, and the electrode 2 is provided with a potential lower than that of the ion source 0. In this way, a uniform electric field is formed between the electrodes 1 and 2. The sample gas introduced from the top of the ion source 0 is ionized, then a huge number of mixed positive and negative ions are generated on both sides of the ion source 0. These ions are primarily distributed in a flat space with the ion source 0 being the center.

Driven by the electric field between the electrodes 1 and 2, the positive ions between the electrode 1 and the ion source 0 penetrate through the ion source 0 and enter the ion gate 4. The negative ions between the electrode 2 and the ion source 0 penetrate through the ion source 0 and enter the ion gate 3. Then, these positive and negative ions can be released into the ion drift tube 6 and the ion drift tube 5 located at both ends by controlling the potentials of the ion gates.

In the above dual IMS, the sample gas can arrive near the ion source 0 and then be ionized. The generated sample ions are mainly centralized in the flat space at both sides of the ion source 0. Further, with the driving force of the adjacent electric field, the mixed positive and negative ions generated at each side of the ion source 0 can penetrate through the ion source 0 and thus be separated to each side of the source body, instead of being lost at both sides of the source.

The foregoing description is only the preferred embodiments of the present invention and not intended to limit the present invention. Those ordinarily skilled in the art will appreciate that any modification or substitution in the principle of the present invention shall fall into the scope of the present invention defined by the appended claims.

What is claimed is:

1. A dual ion mobility spectrometer comprising:

an ion source, a first gate electrode placed on one side of the ion source, wherein a potential at the first gate electrode is higher than a potential at the ion source;

a second gate electrode placed on the other side of the ion source, wherein a potential at the second gate electrode is lower than the potential at the ion source;

a negative gate placed on the side of the first gate electrode away from the ion source;

a positive gate placed on the side of the second gate electrode away from the ion source;

a negative drift tube connected with the negative gate;

a positive drift tube connected with the positive gate;

wherein the ion source is a meshy double-faced ion source, comprising a plate-shaped source body which has radioactivity on both sides and is configured to ionize sample gas to generate positive and negative ions such that the generated positive and negative ions penetrate through the source body; and the source body has a thickness between 0.01 mm and 1 mm.

2. The dual ion mobility spectrometer of claim 1, wherein the source body is formed of radioactive isotope material.

3. The dual ion mobility spectrometer of claim 1, wherein the radioactivity strength of the source body is in the range of 0.5-10 mCi.

4. The dual ion mobility spectrometer of claim 1, wherein the transmittance of the ion source is 25%-95%.

* * * * *